US010247494B2

(12) United States Patent
Baxter et al.

(10) Patent No.: US 10,247,494 B2
(45) Date of Patent: Apr. 2, 2019

(54) METHOD FOR NEGATING DEPOSITS USING TURBULENCE

(71) Applicants: Larry Baxter, Orem, UT (US); David Frankman, Provo, UT (US); Nathan Davis, Bountiful, UT (US)

(72) Inventors: Larry Baxter, Orem, UT (US); David Frankman, Provo, UT (US); Nathan Davis, Bountiful, UT (US)

(73) Assignee: Sustainable Energy Solutions, LLC, Orem, UT (US)

( * ) Notice: Subject to any disclaimer, the term of this patent is extended or adjusted under 35 U.S.C. 154(b) by 87 days.

(21) Appl. No.: 15/430,168

(22) Filed: Feb. 10, 2017

(65) Prior Publication Data

US 2018/0231336 A1 Aug. 16, 2018

(51) Int. Cl.

| | |
|---|---|
| ***F28F 19/00*** | (2006.01) |
| ***F28G 13/00*** | (2006.01) |
| ***F28F 19/01*** | (2006.01) |
| *F28G 9/00* | (2006.01) |
| *F28G 3/16* | (2006.01) |

(52) U.S. Cl.

CPC ..... *F28F 19/00* (2013.01); *F28F 19/01* (2013.01); *F28G 13/00* (2013.01); *F28F 19/008* (2013.01); *F28G 3/16* (2013.01); *F28G 3/163* (2013.01); *F28G 9/00* (2013.01); *F28G 9/005* (2013.01)

(58) Field of Classification Search

CPC ..... F28F 19/00; F28F 13/00; F28F 19/008; F28G 9/00; F28G 9/005; F28G 3/16; F28G 3/163

USPC ..... 165/95; 239/398–406

See application file for complete search history.

(56) References Cited

U.S. PATENT DOCUMENTS

2012/0000626 A1* 1/2012 Watson ..... F28G 3/166 165/95

2018/0292150 A1* 10/2018 Brumfield ..... B08B 3/024

* cited by examiner

*Primary Examiner* — Joel Attey

(57) ABSTRACT

A method for preventing fouling of an operating heat exchanger is disclosed. A carrier liquid is provided to the heat exchanger. The carrier liquid contains a potential fouling agent. The potential fouling agent is entrained in the carrier liquid, dissolved in the carrier liquid, or a combination thereof. The potential fouling agent fouls the heat exchanger by condensation, crystallization, solidification, desublimation, reaction, deposition, or combinations thereof. A gas-injection device is provided on the inlet of the heat exchanger. A non-reactive gas is injected into the carrier liquid through the gas-injection device. The non-reactive gas will not foul the heat exchanger surface and will not condense into the carrier liquid. The non-reactive gas creates a disturbance by increasing flow velocity and creating a shear discontinuity, thereby breaking up crystallization and nucleation sites on the surface of the heat exchanger. In this manner, fouling of the operating heat exchanger is prevented.

19 Claims, 9 Drawing Sheets

METHOD FOR NEGATING DEPOSITS USING TURBULENCE

This invention was made with government support under DE-FE0028697 awarded by The Department of Energy. The government has certain rights in the invention.

BACKGROUND

Field of the Invention

This invention relates generally to the field of heat exchanger operations. Our immediate interest is in preventing deposition of fouling agents on the surfaces of heat exchangers.

Related Technology

Heat exchange is a fundamental unit operation in nearly all chemical processes, from simple in-home heaters to extraordinarily complex industrial furnaces. Typical industrial heat exchangers are typically blocked by scale formation or deposition of entrained solids. Additionally, cryogenic heat exchangers can also be blocked by constituents in the process fluid condensing out of the process fluid and depositing onto the walls of the heat exchanger. These deposits can not only exacerbate deposition of entrained solids, but can block the heat exchanger independently.

Fouling removal methods are common and can include techniques ranging from the complexity of dismantling the system to manually remove scale to the simplicity of banging on the exchanger with a hammer. However, with few exceptions, these techniques all rely on the heat exchangers being shut down, drained, and dismantled. Even cleaning methods that do not require dismantling require draining and use of a cleaning solution. Effective cleaning of heat exchangers during operations, without shutdown, are needed.

U.S. Pat. No. 4,972,805 to Weems teaches a method and apparatus for removing foreign matter from heat exchanger tubesheets. This disclosure is pertinent and may benefit from the methods disclosed herein and is hereby incorporated for reference in its entirety for all that it teaches.

U.S. patent Ser. No. 11/802,617 to Clavenna et al. teaches a method for reducing fouling and the formation of deposits on the inner walls of direct-contact heat exchangers. This disclosure is pertinent and may benefit from the methods disclosed herein and is hereby incorporated for reference in its entirety for all that it teaches.

U.S. patent Ser. No. 12/518,863 to Fieler et al. teaches a controlled freeze zone tower. This disclosure is pertinent and may benefit from the methods disclosed herein and is hereby incorporated for reference in its entirety for all that it teaches.

SUMMARY

A method for preventing fouling of a surface of a process side of an operating heat exchanger is disclosed. A carrier liquid is provided to an inlet of the process side of the operating heat exchanger. The carrier liquid contains a potential fouling agent. The potential fouling agent is entrained in the carrier liquid, dissolved in the carrier liquid, or a combination thereof. The potential fouling agent fouls the surface of the process side of the operating heat exchanger by condensation, crystallization, solidification, desublimation, reaction, deposition, or combinations thereof. A gas-injection device is provided on the inlet of the process side of the operating heat exchanger. A non-reactive gas is injected into the carrier liquid through the gas-injection device. The non-reactive gas will not foul the operating heat exchanger surface and will not condense into the carrier liquid. The non-reactive gas creates a disturbance by increasing flow velocity and creating a shear discontinuity, thereby breaking up crystallization and nucleation sites on the surface of the process side of the operating heat exchanger. In this manner, fouling of the operating heat exchanger is prevented.

The carrier liquid may be water, brine, hydrocarbons, liquid ammonia, liquid carbon dioxide, or combinations thereof. The non-reactive gas may be nitrogen, argon, helium, and hydrogen. The potential fouling agent may be solid particles, miscible liquids, dissolved salts, a fouling gas that may desublimate onto the surface of the operating heat exchanger, or combinations thereof. The fouling gas may be carbon dioxide, nitrogen oxide, sulfur dioxide, nitrogen dioxide, sulfur trioxide, hydrogen sulfide, hydrogen cyanide, water, hydrocarbons with a freezing point above 0 C, or combinations thereof.

The gas-injection device may be aluminum, stainless steel, polymers, carbon steel, ceramics, polytetrafluoroethylene, polychlorotrifluoroethylene, or combinations thereof. The gas-injection device may be a nozzle or a plurality of nozzles. The nozzle may be oriented perpendicular to the inlet of the process side of the operating heat exchanger. The plurality of nozzles may be evenly spaced in a staggered, rotating pattern around the inlet and may be oriented perpendicular to the inlet of the process side of the operating heat exchanger. The plurality of nozzles may be evenly spaced around and may be oriented perpendicular to the inlet of the process side of the operating heat exchanger.

The nozzle may be oriented to inject the cleaning gas at an acute angle away from the inlet to the process side of the operating heat exchanger. The plurality of nozzles may be evenly spaced in a ring around the inlet to the process side of the operating heat exchanger and may be oriented to inject the cleaning gas at an acute angle towards the inlet to the process side of the operating heat exchanger. The plurality of nozzles may be placed in a staggered, rotating pattern around the inlet to the process side of the operating heat exchanger and may be oriented to inject the cleaning gas at an acute angle towards the inlet to the process side of the operating heat exchanger.

The gas-injection device may be a sparger or plurality of spargers. The sparger may be a membrane sparger, porous sintered metal sparger, or orifice sparger. The plurality of spargers may be membrane spargers, porous sintered metal spargers, orifice spargers, or combination thereof.

The mixing chamber may be provided after the gas-injection device but before the inlet to the process side of the operating heat exchanger. The mixing chamber may be aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

The operating heat exchanger may be a brazed plate, aluminum plate, shell and tube, plate, plate and frame, plate and shell, spiral, or plate fin style heat exchanger. The process side of the heat may be aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention.

Figure 1:
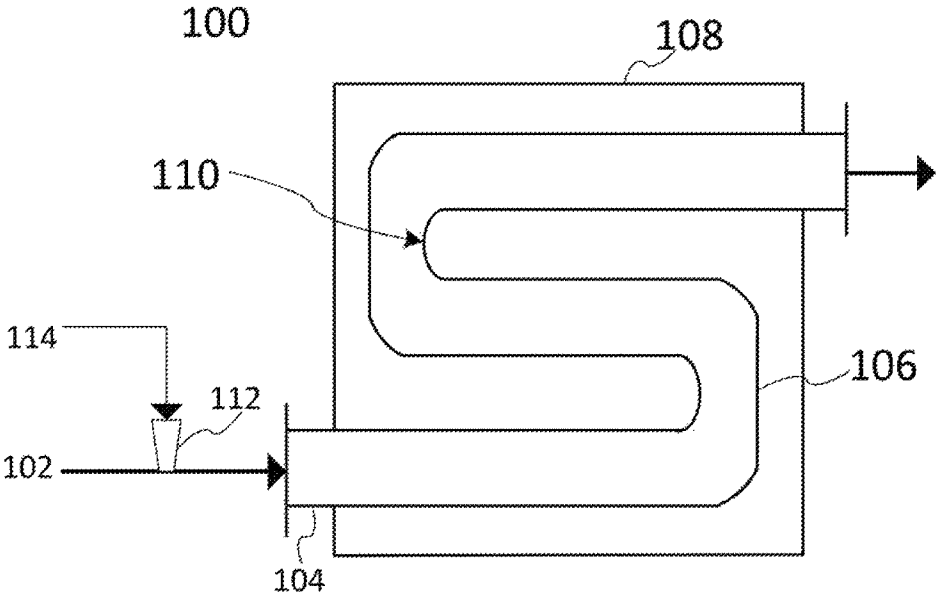
FIG. 1 shows a process flow diagram of an operating heat exchanger.

Referring to FIG. 1, a process flow diagram 100 is shown, as per one embodiment of the present invention. Carrier liquid 102 is provided to inlet 104 of process side 106 of operating heat exchanger 108. Carrier liquid 102 contains a potential fouling agent that is entrained, dissolved, or both entrained and dissolved in carrier liquid 102. The potential fouling agent fouls surface 110 of process side 106 of operating heat exchanger 108 by condensation, crystallization, solidification, desublimation, reaction, deposition, or combinations thereof. Gas-injection device 112 is provided on inlet 104. Non-reactive gas 114 is injected into carrier liquid 102 through gas-injection device 112. Non-reactive gas 114 will not foul surface 110 and will not condense into carrier liquid 102. Non-reactive gas 114 creates a disturbance by increasing flow velocity and creating a shear discontinuity, thereby breaking up crystallization and nucleation sites for the potential fouling agent on surface 110 of process side 106 of operating heat exchanger 108. In this manner, fouling of operating heat exchanger 108 is prevented. While only one nozzle is shown on the diagram, in some embodiments, nozzle 112 may be a plurality of nozzles.

Figure 2:
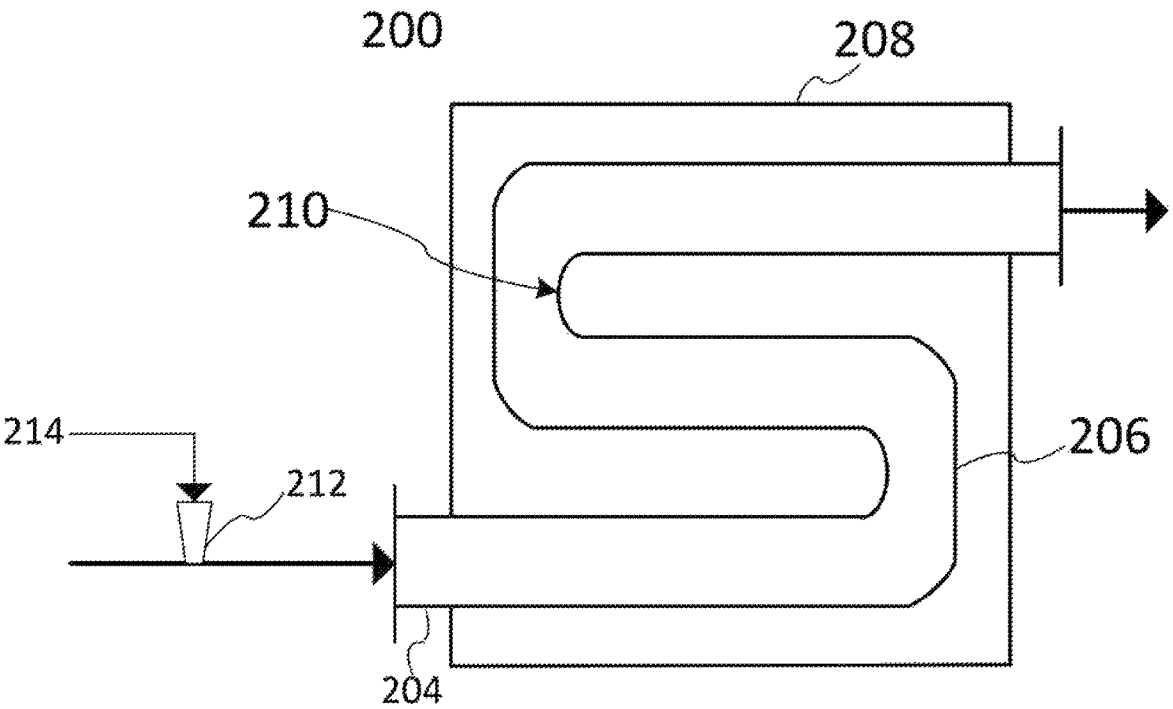
FIG. 2 shows a process flow diagram of an operating heat exchanger.

Referring to FIG. 2, a process flow diagram 200 is shown, as per one embodiment of the present invention. Isopentane liquid 202 is provided to inlet 204 of process side 206 of shell-and-tube style heat exchanger 208. Isopentane liquid 202 contains dissolved carbon dioxide. The carbon dioxide fouls surface 210 of process side 206 of shell and tube heat exchanger 208 by condensation, solidification, desublimation, and deposition. Nozzle 212 is provided on inlet 204. Nitrogen gas 214 is injected into isopentane liquid 202 through nozzle 212. Nitrogen gas 214 will not foul surface 210 and will not condense into isopentane liquid 202. Nitrogen gas 214 creates a disturbance by increasing flow velocity and creating a shear discontinuity, thereby breaking up crystallization and nucleation sites for the potential fouling agent on surface 210 of process side 206 of heat exchanger 208. In this manner, fouling of heat exchanger 208 is prevented. While only one nozzle is shown on the diagram, in some embodiments, nozzle 212 may be a plurality of nozzles.

Figure 3:
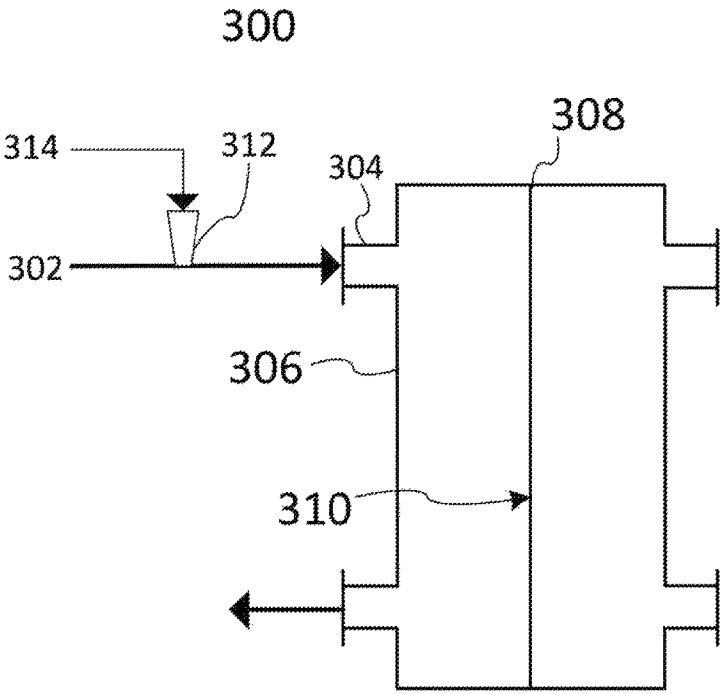
FIG. 3 shows a process flow diagram of an operating heat exchanger.

Referring to FIG. 3, a process flow diagram 300 is shown, as per one embodiment of the present invention. Brine solution 302 is provided to inlet 304 of process side 306 of plate-style heat exchanger 308. Brine solution 302 contains entrained solid particles. The solid particles foul surface 310 of process side 306 of plate-style heat exchanger 308 by deposition. Nozzle 312 is provided on inlet 304. Nitrogen 314 is injected into brine solution 302 through nozzle 312. Nitrogen 314 will not foul surface 310 and will not condense into brine solution 302. Nitrogen 314 creates a disturbance by increasing flow velocity and creating a shear discontinuity, thereby breaking up crystallization and nucleation sites for the solid particles on surface 310 of process side 306 of plate-style heat exchanger 308. In this manner, fouling of plate-style heat exchanger 308 is prevented. While only one nozzle is shown on the diagram, in some embodiments, nozzle 312 may be a plurality of nozzles.

Figure 4:
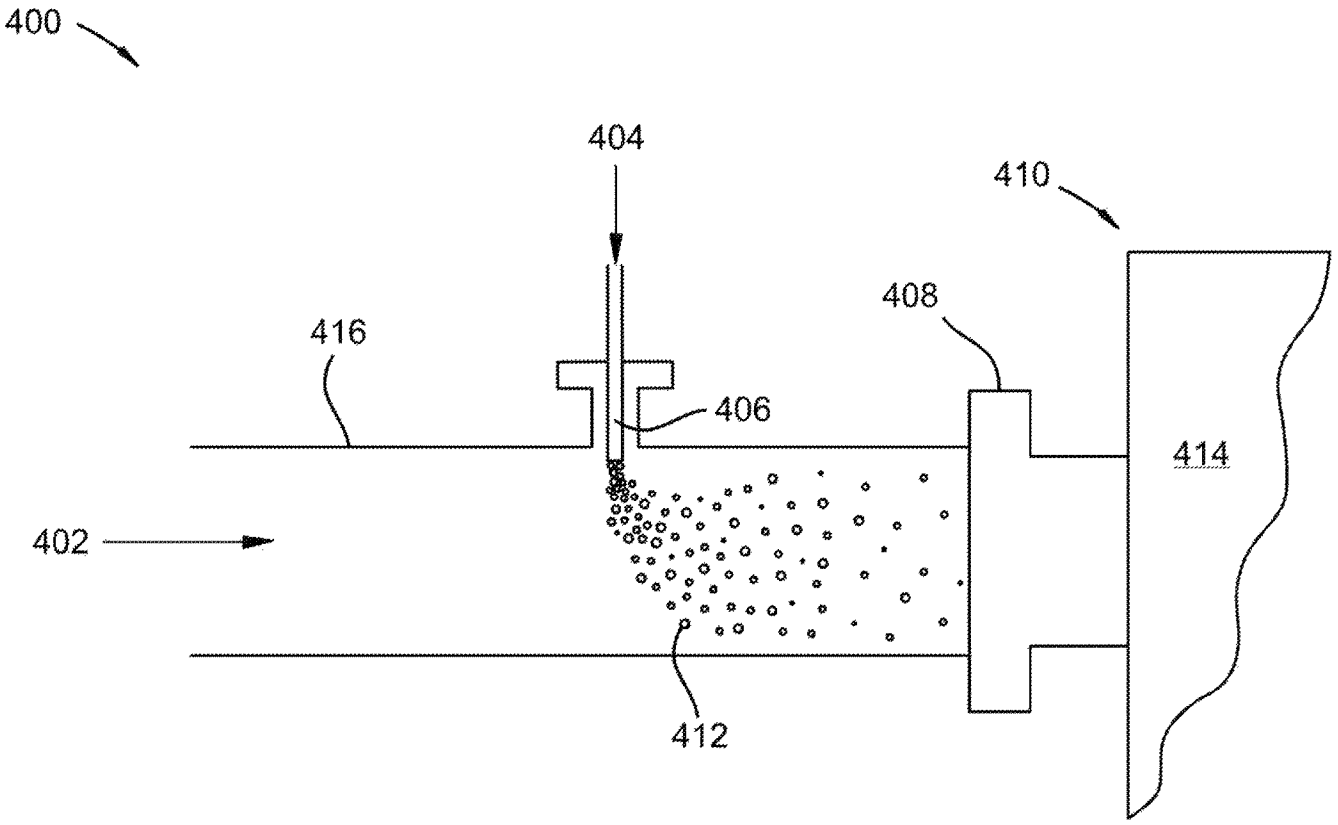
FIG. 4 shows a cross-sectional view of a portion of an operating heat exchanger.

Referring to FIG. 4, a cross-sectional view of inlet 104, of FIG. 1, is shown generally at 400. Carrier liquid 402 is provided to inlet 408 of heat exchanger 410 through pipe 416. The gas-injection device, in this instance nozzle 406, is attached perpendicular to the path of carrier liquid 402. Nozzle 406 injects carrier gas 404 into carrier liquid 402, producing bubbles 412. Bubbles 412 create a disturbance by increasing flow velocity of carrier liquid 402 and creating shear discontinuities, thereby breaking up crystallization and nucleation sites for the potential fouling agent on surface 414.

Figure 5:
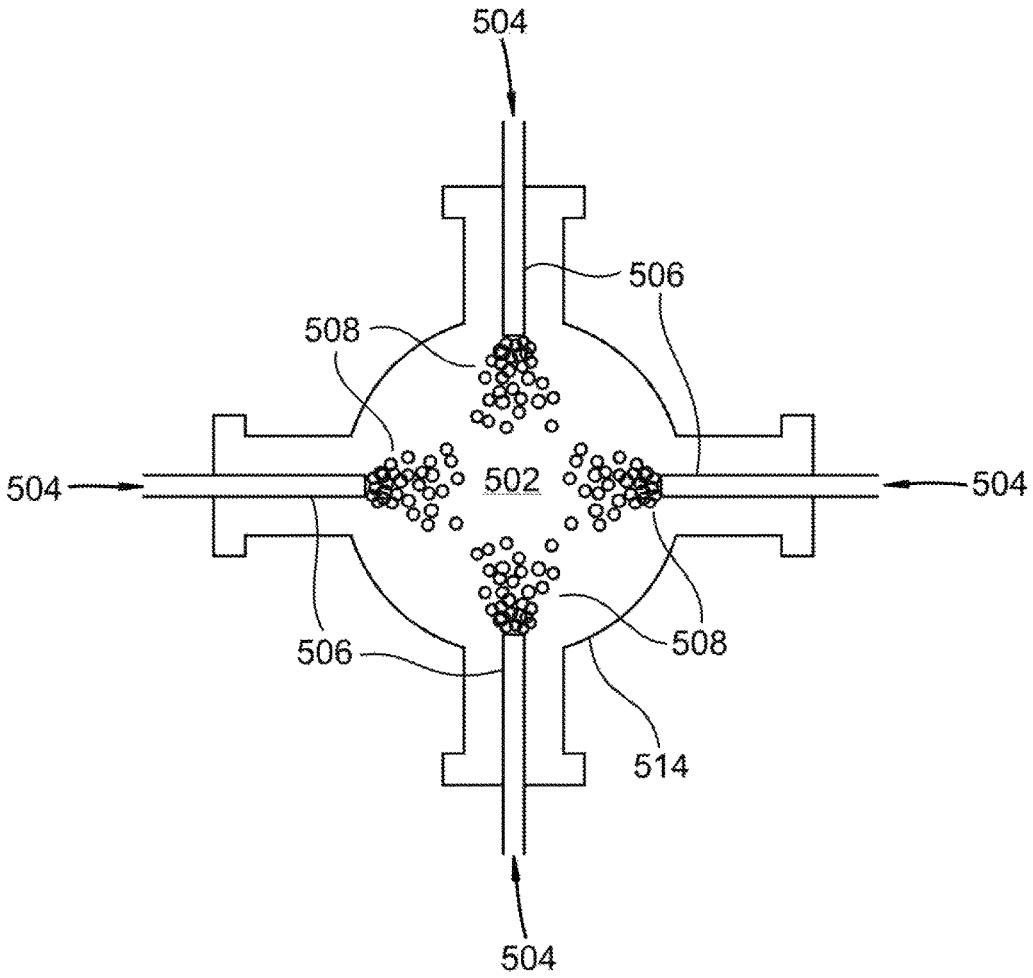
FIG. 5 shows a cross-sectional view of a portion of a gas injection device as part of an operating heat exchanger.

Referring to FIG. 5, a cross-sectional view of gas-injection device 112, of FIG. 1, is shown generally at 500. In this instance, the gas-injection device consists of four nozzles 506. Carrier liquid 502 passes through the center of nozzles 506. Nozzles 506 are attached perpendicular to the path of carrier liquid 402, evenly spaced around pipe 510 and equidistant from inlet 104. Nozzles 506 inject carrier gas 504 into carrier liquid 502, producing bubbles 508. Bubbles 508 create a disturbance by increasing flow velocity of carrier liquid 502 and creating shear discontinuities, thereby breaking up crystallization and nucleation sites for the potential fouling agent on surface 110 of process side 106 of heat exchanger 108.

Figure 6:
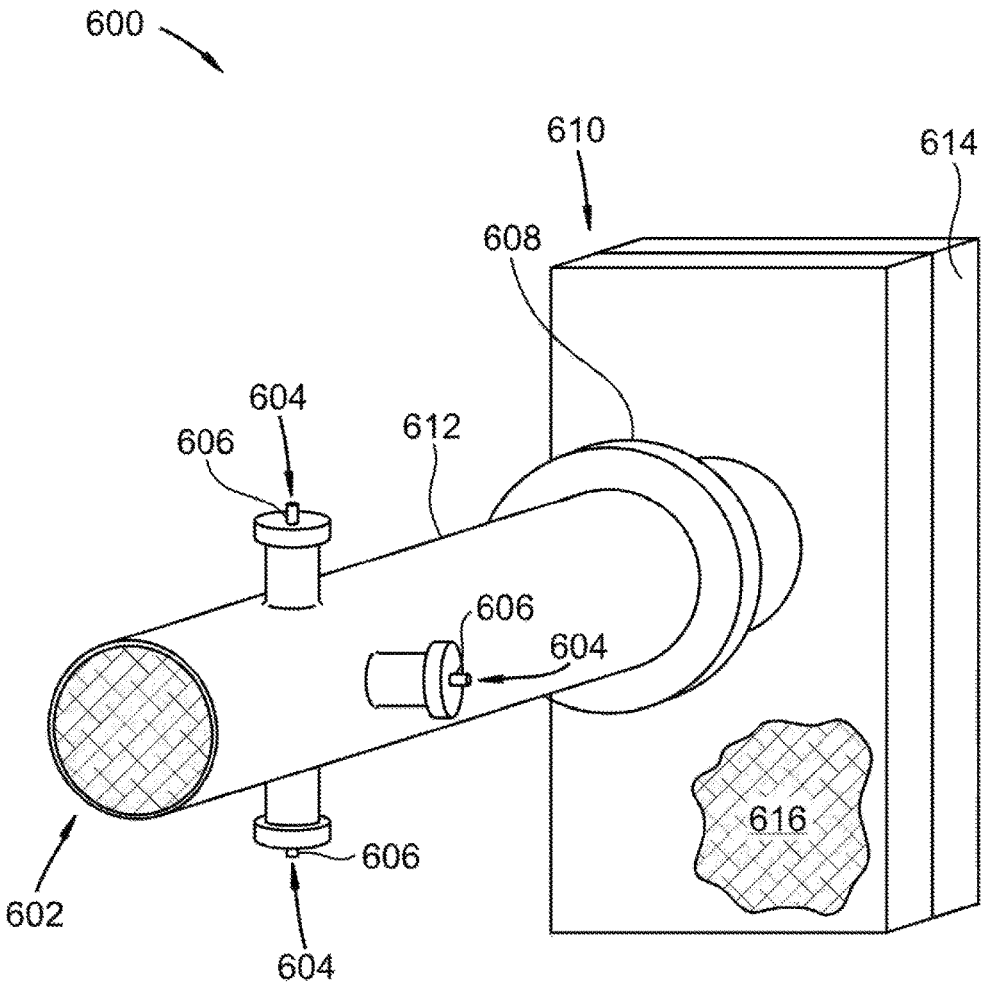
FIG. 6 shows an isometric view of a gas injection device as part of an operating heat exchanger.

Referring to FIG. 6, an isometric view of gas-injection device 312, inlet 304, and part of heat exchanger 308, of FIG. 3, is shown generally at 600. Carrier liquid 602 is provided to inlet 608 of heat exchanger 610 through pipe 612. In this instance, the gas-injection device consists of four nozzles 606. Carrier liquid 602 passes through the center of nozzles 606. Nozzles 606 are provided evenly around the perimeter of pipe 612, equidistant to inlet 608. Nozzles 606 inject carrier gas 604 into carrier liquid 602, producing bubbles inside pipe 612. The bubbles create a disturbance by increasing flow velocity of carrier liquid 602 and creating shear discontinuities, thereby breaking up crystallization and nucleation sites for the potential fouling agent on surface 616 of process side 614 of heat exchanger 610.

Figure 7:
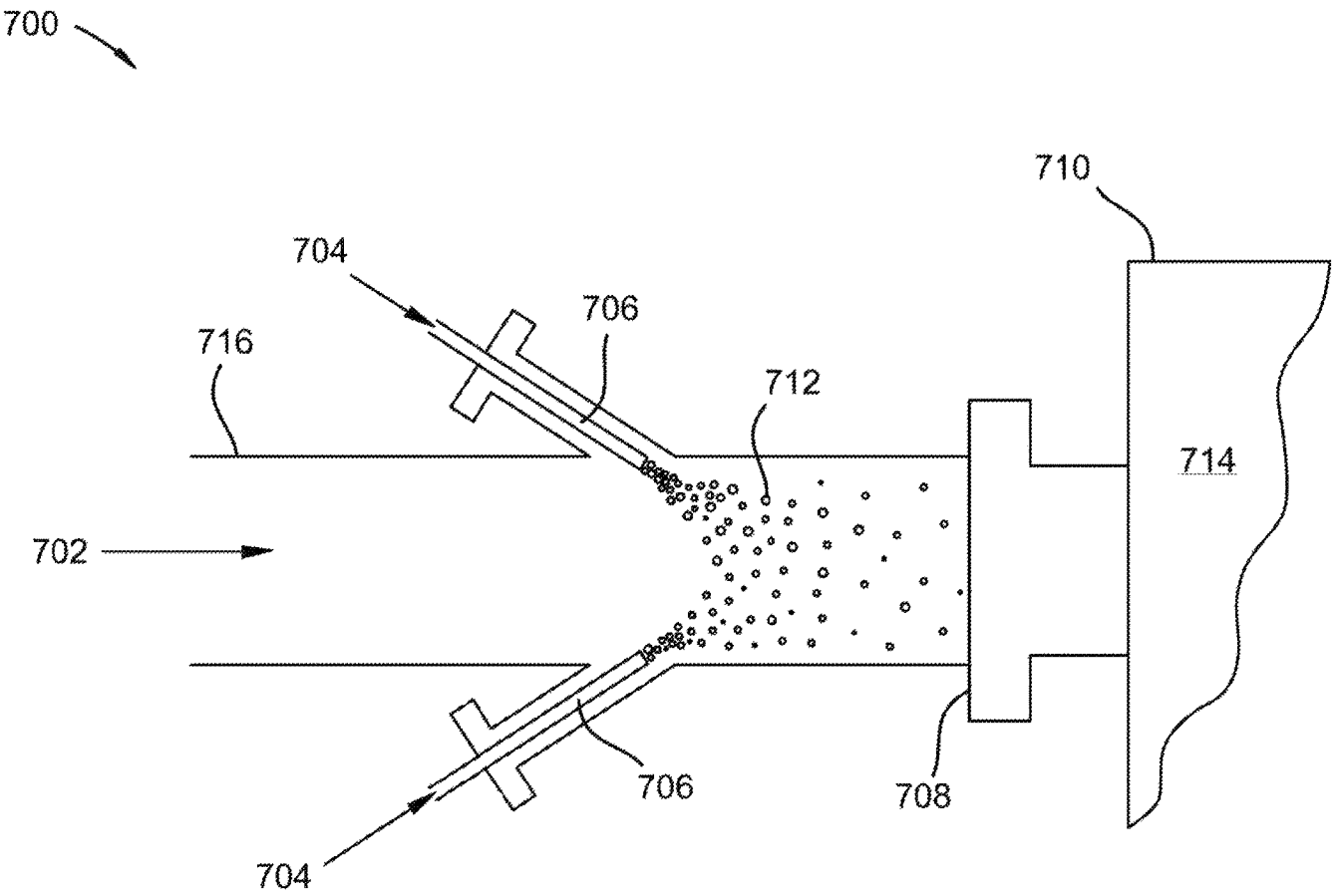
FIG. 7 shows a cross-sectional view of an inlet of an operating heat exchanger

Referring to FIG. 7, a cross-sectional view of inlet 104, of FIG. 1, is shown generally at 700. Carrier liquid 702 is provided to inlet 708 of heat exchanger 710 through pipe 716. In this instance, the gas-injection device consists of two nozzles 706. Nozzles 706 are attached evenly around pipe 716, equidistant from inlet 708, at an acute angle facing towards inlet 708. Nozzles 706 inject carrier gas 704 into carrier liquid 702, producing bubbles 712. Bubbles 712 create a disturbance by increasing flow velocity of carrier liquid 702 and creating shear discontinuities, thereby breaking up crystallization and nucleation sites for the potential fouling agent on surface 714.

Figure 8:
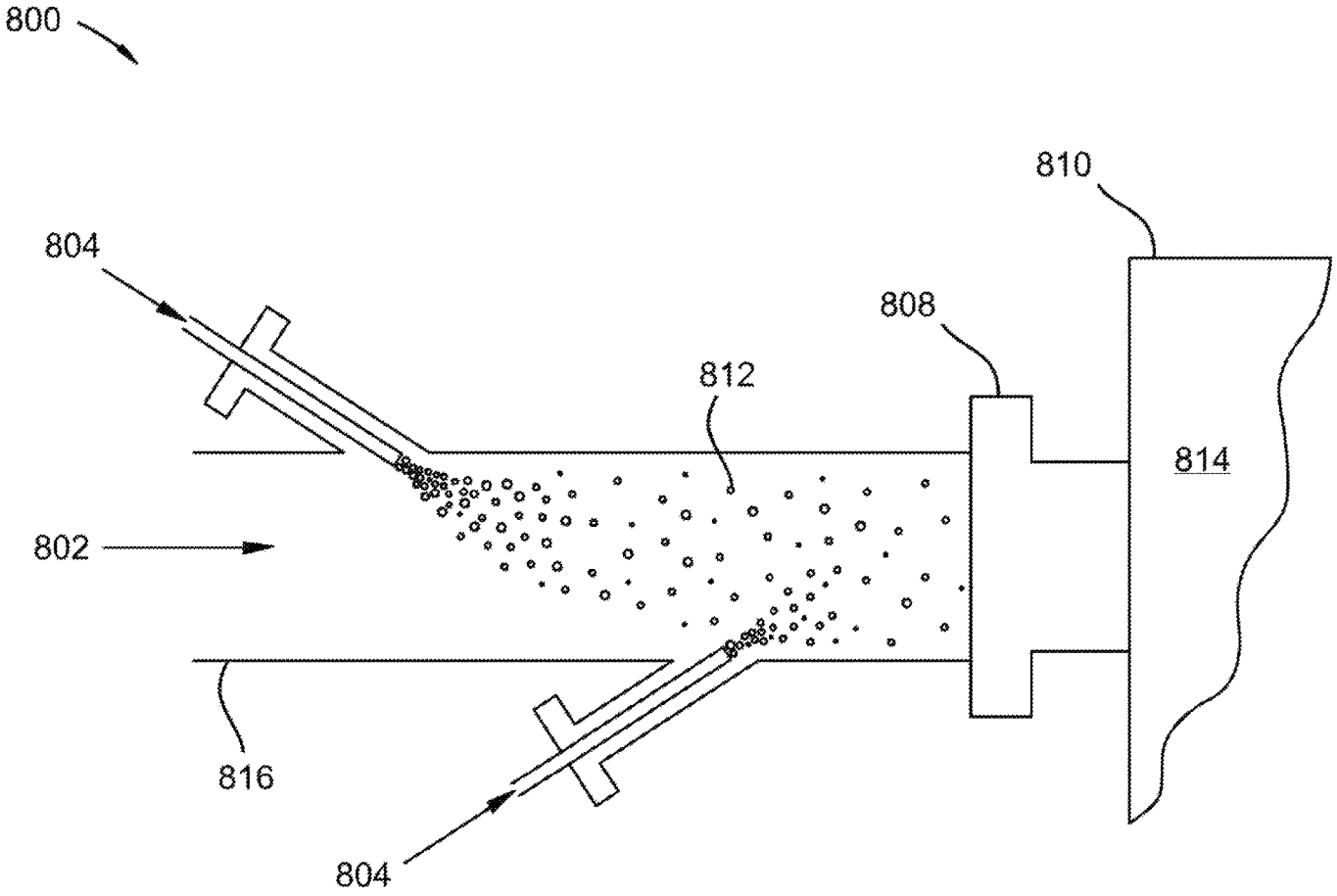
FIG. 8 shows a cross-sectional view of an inlet of an operating heat exchanger.

Referring to FIG. 8, a cross-sectional view of inlet 104, of FIG. 1, is shown generally at 800. Carrier liquid 802 is provided to inlet 808 of heat exchanger 810 through pipe 816. In this instance, the gas-injection device consists of two nozzles 806. Nozzles 806 are attached evenly around pipe 816, at different distances from inlet 808, at an acute angle facing towards inlet 808. Nozzles 806 inject carrier gas 804 into carrier liquid 802, producing bubbles 812. Bubbles 812 create a disturbance by increasing flow velocity of carrier liquid 802 and creating shear discontinuities, thereby breaking up crystallization and nucleation sites for the potential fouling agent on surface 814.

Figure 9:
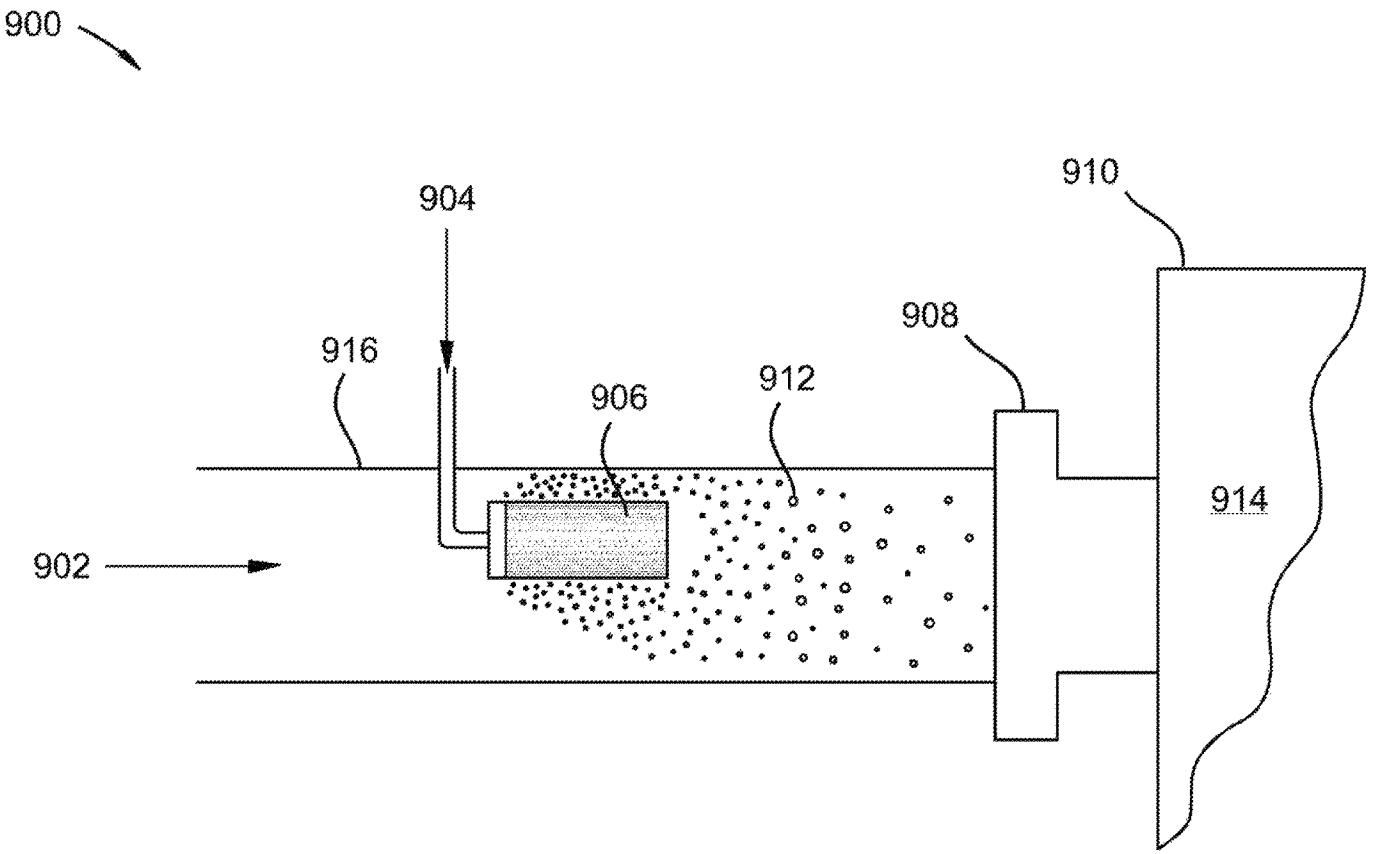
FIG. 9 shows a cross-sectional view of an inlet of an operating heat exchanger.

Referring to FIG. 9, a cross-sectional view of inlet 104, of FIG. 1, is shown generally at 900. Carrier liquid 902 is provided to inlet 908 of heat exchanger 910 through pipe 916. In this instance, the gas-injection device consists of sparger 906. Sparger 906 is inserted into pipe 916. Sparger 906 injects carrier gas 904 into carrier liquid 902, producing bubbles 912. Bubbles 912 create a disturbance by increasing flow velocity of carrier liquid 902 and creating shear discontinuities, thereby breaking up crystallization and nucleation sites for the potential fouling agent on surface 914.

In some embodiments, the carrier liquid may be water, brine, hydrocarbons, liquid ammonia, liquid carbon dioxide, or combinations thereof. The non-reactive gas may be nitrogen, argon, helium, hydrogen, air, or combinations thereof. The potential fouling agent may be solid particles, miscible liquids, dissolved salts, a fouling gas that may desublimate onto the surface of the operating heat exchanger, or combinations thereof. The fouling gas may be carbon dioxide, nitrogen oxide, sulfur dioxide, nitrogen dioxide, sulfur trioxide, hydrogen sulfide, hydrogen cyanide, water, hydrocarbons with a freezing point above 0 C, or combinations thereof.

In some embodiments, the gas-injection device may be aluminum, stainless steel, polymers, carbon steel, ceramics, polytetrafluoroethylene, polychlorotrifluoroethylene, or combinations thereof. The gas-injection device may be a nozzle, a plurality of nozzles, a sparger or a plurality of spargers. The nozzle or nozzles may be oriented perpendicular to the inlet of the process side of the operating heat exchanger. In instances where there are a plurality of nozzles, the nozzles may be evenly spaced or placed in a staggered, rotating pattern around the inlet. and may be oriented perpendicular to, or at an acute angle towards or away from, the inlet of the process side of the operating heat exchanger.

In some embodiments, the sparger or spargers may be a membrane sparger, porous sintered metal sparger, orifice sparger, or combinations thereof.

In some embodiments, a mixing chamber may be provided after the gas-injection device but before the inlet to the process side of the operating heat exchanger. The mixing chamber may be aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

In some embodiments, the operating heat exchanger may be a brazed plate, aluminum plate, shell and tube, plate, plate and frame, plate and shell, spiral, or plate fin style heat exchanger. The process side of the operating heat exchanger may be aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

The invention claimed is:

1. A method for preventing fouling of a surface of a process side of an operating heat exchanger, the method comprising:

providing a carrier liquid to an inlet of the process side of the operating heat exchanger, wherein:

the carrier liquid contains a potential fouling agent;

the potential fouling agent is entrained in the carrier liquid, dissolved in the carrier liquid, or a combination thereof; and, the potential fouling agent fouls the surface of the process side of the operating heat exchanger by condensation, crystallization, solidification, desublimation, reaction, deposition, or combinations thereof; providing a gas-injection device on the inlet of the process side of the operating heat exchanger;

wherein the gas-injection device comprises a plurality of nozzles, the plurality of nozzles are placed in a pattern around the inlet to the process side of the operating heat exchanger;

injecting a non-reactive gas into the carrier liquid through the gas-injection device, wherein the non-reactive gas will not foul the surface of the process side of the operating heat exchanger and will not condense into the carrier liquid;

wherein the non-reactive gas creates a disturbance by increasing flow velocity and creating a shear discontinuity, thereby breaking up crystallization and nucleation sites for the potential fouling agent on the surface of the process side of the heat exchanger;

whereby fouling of the operating heat exchanger is prevented.

2. The method of claim 1, wherein the carrier liquid comprises water, brine, hydrocarbons, liquid ammonia, liquid carbon dioxide, or combinations thereof.

3. The method of claim 1, wherein the non-reactive gas comprises nitrogen, argon, helium, hydrogen, air, or combinations thereof.

4. The method of claim 1, wherein the potential fouling agent comprises solid particles, miscible liquids, dissolved salts, a fouling gas that may desublimate onto the surface of the operating heat exchanger, or combinations thereof.

5. The method of claim 4, wherein the fouling gas comprises carbon dioxide, nitrogen oxide, sulfur dioxide, nitrogen dioxide, sulfur trioxide, hydrogen sulfide, hydrogen cyanide, water, hydrocarbons with a freezing point above 0 C, or combinations thereof.

6. The method of claim 1, wherein the gas-injection device comprises aluminum, stainless steel, polymers, carbon steel, ceramics, polytetrafluoroethylene, polychlorotrifluoroethylene, or combinations thereof.

7. The method of claim 1, wherein the plurality of nozzles is oriented perpendicular to the inlet of the process side of the operating heat exchanger.

8. The method of claim 1, wherein the plurality of nozzles are evenly spaced in a staggered, rotating pattern around the inlet and are oriented perpendicular to the inlet of the process side of the operating heat exchanger.

9. The method of claim 1, wherein the plurality of nozzles are evenly spaced around and oriented perpendicular to the inlet of the process side of the operating heat exchanger.

10. The method of claim 1, wherein the plurality of nozzles is oriented to inject the cleaning gas at an acute angle away from the inlet to the process side of the operating heat exchanger.

11. The method of claim 1, wherein the plurality of nozzles are evenly spaced in a ring around the inlet to the process side of the operating heat exchanger and are oriented to inject the cleaning gas at an acute angle towards the inlet to the process side of the operating heat exchanger.

12. The method of claim 1, wherein the plurality of nozzles are placed in a staggered, rotating pattern around the inlet to the process side of the operating heat exchanger and are oriented to inject the cleaning gas at an acute angle towards the inlet to the process side of the operating heat exchanger.

13. The method of claim 1, wherein the gas-injection device comprises a sparger or plurality of spargers.

14. The method of claim 13, wherein the sparger comprises a membrane sparger, porous sintered metal sparger, or orifice sparger.

15. The method of claim 13, wherein the plurality of spargers comprise a membrane sparger, porous sintered metal sparger, orifice sparger, or combination thereof.

16. The method of claim 1, wherein a mixing chamber is provided after the gas-injection device but before the inlet to the process side of the operating heat exchanger.

17. The method of claim 1, wherein the mixing chamber comprises aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

18. The method of claim 1, wherein the operating heat exchanger comprises a brazed plate, aluminum plate, shell and tube, plate, plate and frame, plate and shell, spiral, or plate fin style heat exchanger.

19. The method of claim 1, wherein the process side of the operating heat exchanger comprises aluminum, stainless steel, polymers, carbon steel, ceramics, polytetrafluoroethylene, polychlorotrifluoroethylene, natural diamond, man-made diamond, chemical-vapor deposition diamond, polycrystalline diamond, or combinations thereof.

* * * * *